US008505549B2

(12) United States Patent
Jurado et al.

(10) Patent No.: US 8,505,549 B2
(45) Date of Patent: Aug. 13, 2013

(54) METHOD FOR SMOKING A HAND-ROLLED CIGARETTE

(76) Inventors: Robert Jurado, Fillmore, CA (US); Stephen Shoemaker, Jr., Redondo Beach, CA (US)

( * ) Notice: Subject to any disclaimer, the term of this patent is extended or adjusted under 35 U.S.C. 154(b) by 730 days.

(21) Appl. No.: 12/704,223

(22) Filed: Feb. 11, 2010

(65) Prior Publication Data

US 2011/0192409 A1 Aug. 11, 2011

(51) Int. Cl.
*A24F 11/00* (2006.01)

(52) U.S. Cl.
USPC ..... 131/328; 131/187; 131/58; 131/77; 131/280

(58) Field of Classification Search
USPC ..... 131/328, 187, 58, 77, 175, 280, 27.1
See application file for complete search history.

(56) References Cited

U.S. PATENT DOCUMENTS 1,374,686 A * 4/1921 Stevens ..... 131/77
4,319,588 A * 3/1982 Evans ..... 131/280

* cited by examiner

*Primary Examiner* — Richard Crispino
*Assistant Examiner* — Dionne Walls Mayes
(74) *Attorney, Agent, or Firm* — Fulwider Patton LLP

(57) ABSTRACT

The present invention is a holder and method for using a holder that works with a hand rolled cigarette. A hollow tubular member is utilized having a first end that the user breathes from, and a second end that holds the hand-rolled cigarette. The cigarette is tightly rolled about an elongate steel rod or other stiff member having a diameter that can pass through the hollow tubular member, such that the rod protrudes from the cigarette far enough to be easily grasped by the user. The user inserts the rod through the holder until it passes out the first end, thereby wedging the attached cigarette into the second end of the holder. The second end of the holder preferably has internal threads, and the rod is twisted by the user to further engage the threads by the cigarette end to reliably affix the cigarette to the holder. The rod is then removed, leaving the cigarette firmly in the holder.

4 Claims, 1 Drawing Sheet

METHOD FOR SMOKING A HAND-ROLLED CIGARETTE

BACKGROUND

The present invention is directed to a type of cigarettes commonly called "hand-rolled" cigarettes, and more particularly to an apparatus and method for smoking such a cigarette that allows the entire cigarette to be consumed.

Cigarette holders are well-known in the art and have been around for many years. However, prior art cigarette holders were specifically designed for mass produced cigarettes from major cigarette brands. There is no product or method of satisfactorily holding a hand rolled cigarette such that the fingers do not touch the cigarette.

With the rise in popularity in hand rolled cigarettes and the proliferation of medical marijuana establishments, there is a need for a holder of hand rolled tobacco or marijuana cigarettes. The present invention has the advantage over prior art holders that the entire cigarette can be consumed, whereas prior art holders required that a portion of the cigarette be retained in the holder until discarded. This is not only wasteful but contributes to litter, higher expense, and injury as users try to smoke as much of the cigarette as possible until their fingers become hot.

SUMMARY OF THE INVENTION

The present invention is a holder and method for using a holder that works with a hand rolled cigarette. A hollow tubular member is utilized having a first end that the user breathes from, and a second end that holds the hand-rolled cigarette. The cigarette is tightly rolled about an elongate steel rod or other stiff member having a diameter that can pass through the hollow tubular member, such that the rod protrudes from the cigarette far enough to be easily grasped by the user. The user inserts the rod through the holder until it passes out the first end, thereby wedging the attached cigarette into the second end of the holder. The second end of the holder preferably has internal threads, and the rod is twisted by the user to further engage the threads by the cigarette end to reliably affix the cigarette to the holder. The rod is then removed, leaving the cigarette firmly in the holder. The removal of the rod creates a portal for air to pass through the cigarette, so that tar or other by-products do not clog the holder during the smoking process. This allows the cigarette to be lit and consumed completely without a butt or "roach" that must be discarded.

DETAILED DESCRIPTION OF THE PREFERRED EMBODIMENTS

Figure 1:
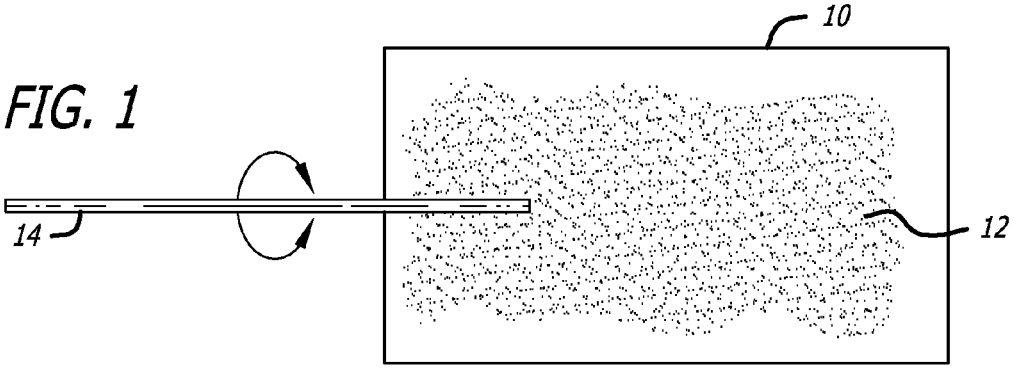
FIG. 1 is a plan view of the unrolled cigarette and cylindrical rod prior to the cigarette being rolled.
Figure 2:
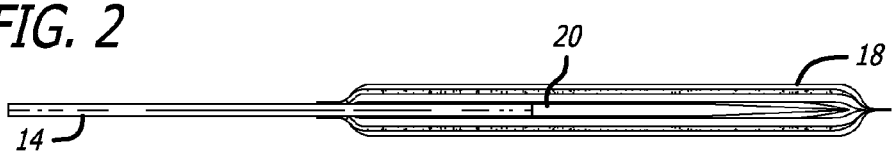
FIG. 2 is a cross-sectional view of the cigarette after rolling with the rod inserted therein.

FIG. 1 illustrates a plan of a cigarette paper 10 having a combustible material 12 such as tobacco or the like laid out on the paper in preparation for rolling. Placed about a quarter of the way on the paper is a cylindrical rod 14 of steel or other material of sufficient stiffness to transfer a torque as set forth below. In one preferred embodiment the rod can be a simple nail with a minimal head. As described below, the nail or rod 14 must have a diameter sufficiently small to pass completely through a hollow holder 16. With the rod 14 over the paper, the cigarette is rolled in the traditional manner except the rod 14 or nail is captured in the rolled cigarette 18. As shown in FIG. 2, the rod 14 is captured in the rolled cigarette and a channel 20 is formed along the axis of the cigarette extending axially toward the distal end due to the presence of the rod 14.

Figure 3:
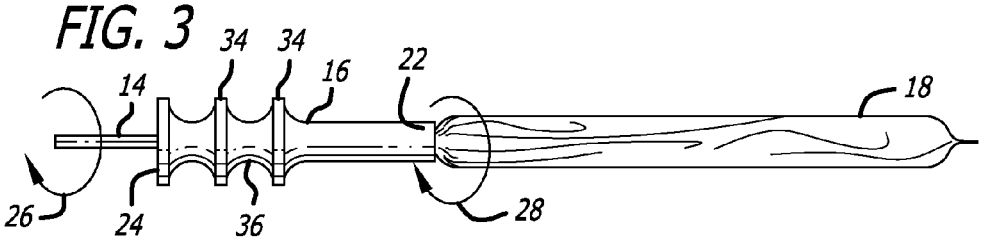
FIG. 3 is a side view of the cigarette inserted into the holder such that the rod protrudes through a first end, further indication rotation of the rod causing rotation of the cigarette in the holder.
Figure 4:
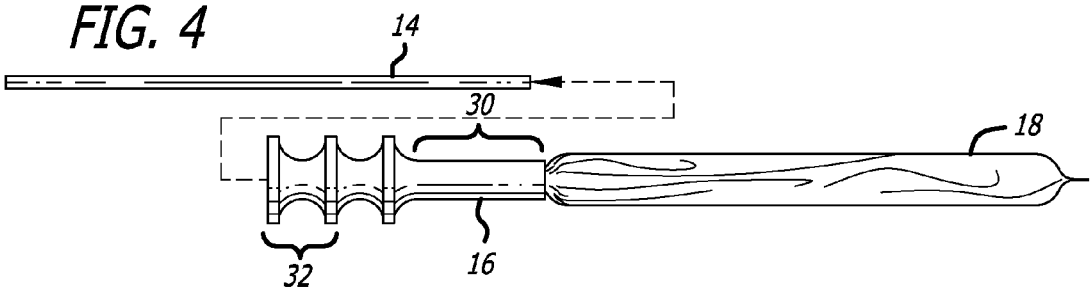
FIG. 4 is a side view showing removal of the cylindrical rod leaving the cigarette in the holder.
Figure 5:
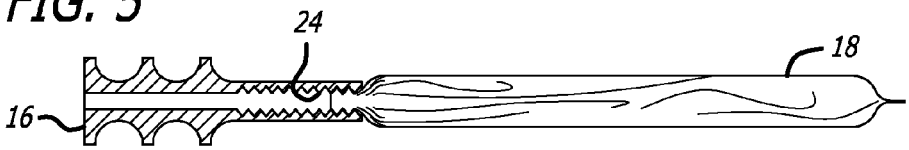
FIG. 5 is a cross-sectional view of the holder showing the internal threads engaging the end of the cigarette.

The cigarette 18 with the rod 14 is then inserted into the distal end 22 of the cylindrical holder 16 as shown in FIG. 3 such that the rod 14 extends through the holder 16 and exits the proximal end 24 until a portion of the rod 14 is exposed. The portion of the rod 14 protruding through the holder 16 is preferably sufficient to be grasped between a finger and thumb, such as one inch. The cigarette 18 is wedged into the distal end 22 of the holder 16 until a tight fit is achieved by the pulling of the rod 14 through the holder 16 due to the tight cooperation of the rolling of the cigarette 18 about the rod 14. The distal end 22 of the holder is preferably formed with internal threads 24 extending from approximately the midpoint of the holder to the distal end. With the cigarette 18 tightly wedged into the holder 16, the rod 14 is rotated as shown by arrow 26 causing cigarette 18 to rotate in the direction of arrow 28. This rotation of the cigarette while wedged into the distal end of the holder causes the tip of the cigarette to engage the internal threads 24 and fix the cigarette in the holder 16 by virtue of the engagement of the cigarette with the threads 24 as shown in FIG. 5. Once the cigarette 18 is firmly fixed into the holder 16, the rod is pulled out of the cigarette 18 and it is ready to be smoked by the user. The channel 20 created by the rod 14 provides a passage for air and prevents tar or other contaminants from clogging the holder that prevents a full consumption of the cigarette 18. That is, the cigarette 18 as shown in FIG. 5 can be completely smoked leaving no butt.

The holder 16 can take many shapes, but preferably has a straight cylindrical portion 30 and a plurality of spool shaped members 32 with a radially outwardly formed disks 34 separated by hyperboloid segments 36. The user can hold the disks 34 while the heat is dissipated through the cylindrical portion 30 and the hyperboloid segments 36 to avoid burning the fingers. Other shapes can be used equally well that are consistent with the present invention.

The foregoing disclosure is intended to be illustrative of the present invention but not limiting, and neither the figures nor the descriptions should be taken as the only means of carrying out the invention. Rather, the scope of the invention is properly determined to be governed by the ordinary words of the appended claims as would be understood by one of ordinary skill in the art.

We claim:

1. A method for smoking a hand rolled cigarette comprising:

providing a hollow, tubular holder having internal threads extending to a distal end thereof;

rolling a cigarette paper having a combustible material thereon around a cylindrical member to form a cigarette such that a portion of the cylindrical member extends from a proximal end of the formed cigarette;

inserting a proximal end of the cylindrical member which extends from the proximal end of the cigarette into the distal end of the holder until the proximal end of the cylindrical member protrudes through and extends from a proximal end of the holder and the proximal end of the cigarette lies within the distal end of the holder adjacent the internal threads;

rotating the proximal end of the cylindrical member to engage the internal threads of the holder with the cigarette to firmly secure the cigarette to the holder;

removing the cylindrical member from the proximal end of the holder, leaving the cigarette firmly in the holder; and smoking the cigarette to completion.

2. The method of claim 1 where the cylindrical member is a nail.

3. The method of claim 1 wherein the cylindrical member is circumscribed by the cigarette such that approximately one inch of a distal end of the cylindrical member is enclosed within the formed cigarette.

4. The method of claim 1 wherein the holder includes a plurality of spool shaped elements at its proximal end.

* * * * *